US007641317B2

(12) United States Patent
Matsui et al.

(10) Patent No.: US 7,641,317 B2
(45) Date of Patent: Jan. 5, 2010

(54) LIQUID DISCHARGE RECORDING HEAD AND LIQUID DISCHARGE RECORDING HEAD CARTRIDGE INCLUDING THE SAME

(75) Inventors: Takahiro Matsui, Koganei (JP); Takuya Hatsui, Setagaya-ku (JP); Yoshiyuki Imanaka, Kawasaki (JP); Souta Takeuchi, Yokohama (JP); Takaaki Yamaguchi, Yokohama (JP); Kousuke Kubo, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 441 days.

(21) Appl. No.: 11/400,255

(22) Filed: Apr. 7, 2006

(65) Prior Publication Data

US 2006/0232637 A1 Oct. 19, 2006

(30) Foreign Application Priority Data

Apr. 13, 2005 (JP) ..... 2005-115985

(51) Int. Cl.
*B41J 2/05* (2006.01)

(52) U.S. Cl. ..... 347/65; 347/63

(58) Field of Classification Search ..... 347/65, 347/6, 44, 47, 48, 63, 94
See application file for complete search history.

(56) References Cited

U.S. PATENT DOCUMENTS

| | | | | |
|---|---|---|---|---|
| 5,793,393 | A * | 8/1998 | Coven | 347/65 |
| 6,652,079 | B2 * | 11/2003 | Tsuchii et al. | 347/65 |
| 6,789,877 | B2 * | 9/2004 | Murakami et al. | 347/40 |
| 2002/0063756 | A1 | 5/2002 | Tsuchii et al. | |
| 2003/0210297 | A1 * | 11/2003 | Vanhooydonck et al. | 347/41 |

FOREIGN PATENT DOCUMENTS

JP 7-137293 A 5/1995

* cited by examiner

*Primary Examiner*—Matthew Luu
*Assistant Examiner*—Henok Legesse
(74) *Attorney, Agent, or Firm*—Canon USA Inc IP Div

(57) ABSTRACT

A liquid discharge recording head includes a substrate having a liquid supply opening facilitating supplying liquid and heating resistors for generating energy for discharging the liquid, a flow path member having discharge openings and flow paths including first and second flow paths that are adjacent each other, the second flow path being longer than the first flow path, and a first resister corresponding to the first flow path and a second resistor corresponding to the second flow path, each of the first and second resistors being disposed at an area of the flow path member which is situated in correspondence with the liquid supply opening, wherein an amount of protrusion of the first resister at a side of the first flow path is greater than an amount of protrusion of the second resister at a side of the second flow path.

7 Claims, 6 Drawing Sheets

LIQUID DISCHARGE RECORDING HEAD AND LIQUID DISCHARGE RECORDING HEAD CARTRIDGE INCLUDING THE SAME

BACKGROUND OF THE INVENTION

1. Field of the Invention

The present invention relates to a liquid discharge recording head for performing a recording operation by discharging a liquid, such as ink, and a liquid discharge recording head cartridge including the recording head.

2. Description of the Related Art

A related liquid discharge recording head discharges liquid drops, such as ink drops, from a plurality of discharge openings by generating and making use of mechanical or thermal energy. In such a liquid discharge recording head, flow path resistances to the flow of liquid between a liquid supply opening and the discharge openings are adjusted by the shapes of the nozzles to thereby determine characteristics, such as liquid discharge amount and refill frequency. More specifically, the adjustment of the flow path resistances by the shapes of the nozzles is performed by adjusting the width and the length of the flow paths. For example, Japanese Patent Laid-Open No. 7-137293 discloses a method of forming nozzles having different flow path resistances by changing the widths of the flow paths according to the nozzles.

In recent years, a liquid discharge recording head which can perform high-speed and high-quality recording as a result of disposing its nozzles close to each other at a high density has been proposed. As the nozzles are disposed closer together at a higher density, the space for disposing one nozzle becomes narrow, thereby tending to place constraints on the manufacturing of the nozzles. Therefore, in a liquid discharge recording head whose nozzles are disposed at a density of at least 90 dpi, it is necessary to dispose the nozzles and heating resistors (heaters) in what is called a staggered arrangement in order to dispose adjacent nozzles so that the distances from discharge openings to a liquid supply opening differ.

When the nozzles and the heaters are disposed in a staggered arrangement, in order to make the liquid discharge amounts from all of the nozzles the same, the discharge characteristics of the nozzles having large distances from the discharge openings to the liquid supply opening and the distance characteristics of the nozzles having small distances from the discharge openings to the liquid supply opening must be about the same. This is generally achieved by making the flow path resistances of the long nozzles small and the flow path resistances of the short nozzles large. In order to make the flow path resistances of the long nozzles small, it is necessary to increase the widths of the flow paths. However, when the nozzles are disposed at a high density of at least 900 dpi, it is difficult to increase the widths of the flow paths due to, as mentioned above, the narrow space for disposing the nozzles and manufacturing constraints.

In addition, in order to increase refill frequency after discharging liquid, it is necessary to reduce the lengths of the flow paths by bringing the discharge openings and the liquid supply opening closer to each other at all of the nozzles. However, for the nozzles having relatively small distances from the discharge openings to the liquid supply opening, there is a limit as to how close these discharge openings can be brought close to the liquid supply opening due to nozzle disposing space and manufacturing constraints. Therefore, it is difficult to provide the short nozzles with the proper flow path resistances in accordance with those of the long nozzles. Consequently, the refill frequency cannot be sufficiently increased.

Accordingly, when the nozzles and the heaters are disposed in a staggered arrangement at a high density, it is very difficult to adjust the flow path resistances by changing the widths and lengths of the flow paths in accordance with the lengths of the nozzles due to nozzle disposing space and manufacturing constraints. In addition, in order to make the space between the liquid supply opening and the flow paths as small as possible, it may be desirable not to dispose a nozzle filter between the flow paths and the liquid supply opening in a related liquid discharge recording head.

SUMMARY OF THE INVENTION

The present invention is directed to a liquid discharge recording head which has nozzles disposed in a staggered arrangement at a high density and which can provide optimum discharge characteristics by adjusting flow path resistances in accordance with the distances from a liquid supply opening to discharge openings, and to a liquid discharge recording head cartridge including the recording head.

According to one aspect of the present invention, there is provided a liquid discharge recording head including a substrate, a flow path member, a first resister, and a second resister. The substrate has a liquid supply opening facilitating supplying the liquid and a plurality of heating resistors for generating energy for discharging the liquid. The flow path member has a plurality of discharge openings and a plurality of flow paths. The plurality of discharge openings are disposed in correspondence with the plurality of heating resistors. The plurality of flow paths connect the plurality of discharge openings and the liquid supply opening to each other. The plurality of liquid flow paths include a first flow path and a second flow path that are adjacent each other, the second flow path being longer than the first flow path. The first resister corresponding to the first flow path and the second resistor corresponding to the second flow path are each disposed at an area of the flow path member that is situated in correspondence with the liquid supply opening. An amount of protrusion of the first resistor at a side of the first flow path is greater than an amount of protrusion of the second resister at a side of the second flow path.

According to another aspect of the present invention, there is provided a liquid discharge recording head cartridge including the above-described liquid discharge recording head and a liquid container.

The present invention makes it possible to adjust the flow path resistances of nozzles having different lengths by making the positions and shapes of resisters disposed facing a liquid supply opening different from each other. Accordingly, even in a liquid discharge recording head having nozzles arranged in a staggered arrangement at a high density, discharge characteristics can be made the same, so that high-speed and high-quality recording is achieved.

Further features of the present invention will become apparent from the following description of exemplary embodiments with reference to the attached drawings.

DESCRIPTION OF THE EMBODIMENTS

Embodiments of the present invention will hereunder be described in detail with reference to the drawings.

Figure 1A:
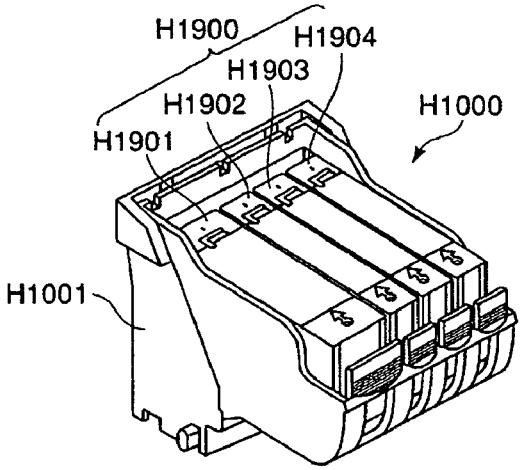
FIG. 1A is a perspective view of an inkjet recording head cartridge including a liquid discharge recording head according to the present invention.
Figure 1B:
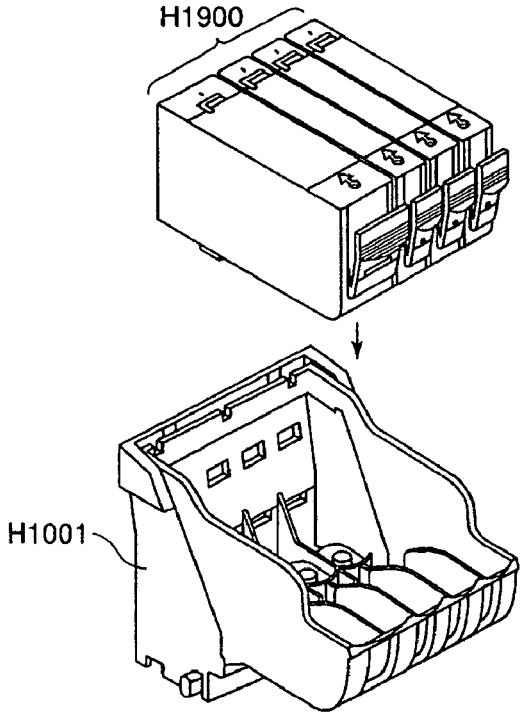
FIG. 1B is an exploded perspective view of the inkjet recording head cartridge shown in FIG. 1A.

First, the entire structure of a liquid discharge recording head (hereafter simply referred to as "recording head") H1001 according to the present invention will be described. As shown in FIGS. 1A and 1B, the recording head H1001 is one structural component of a recording head cartridge H1000. The recording head cartridge H1000 includes the recording head H1001 and ink tanks H1900 removably mounted to the recording head H1001. The ink tanks H1900 include a black ink tank H1901, a cyan ink tank H1902, a magenta ink tank H1903, and a yellow ink tank H1904. The recording head H1001 discharges ink (recording liquid) supplied from the ink tanks H1900 through discharge openings in accordance with recording information.

Although not shown, a liquid discharge recording device according to the present invention includes a carriage (not shown), and the recording head cartridge H1000 is positioned with respect to the carriage by a positioning member so as to be removably secured to the carriage. The recording head H1001 is connected to an electrical contact of the carriage. When the recording head H1001 receives an electrical signal, a heating resistor (heater) is selectively driven in accordance with the electrical signal and generates heat. The recording head H1001 causes film boiling to occur in the ink by thermal energy of the recording head H1001 and discharges the ink towards a recording medium, thereby performing a recording operation.

Figure 2:
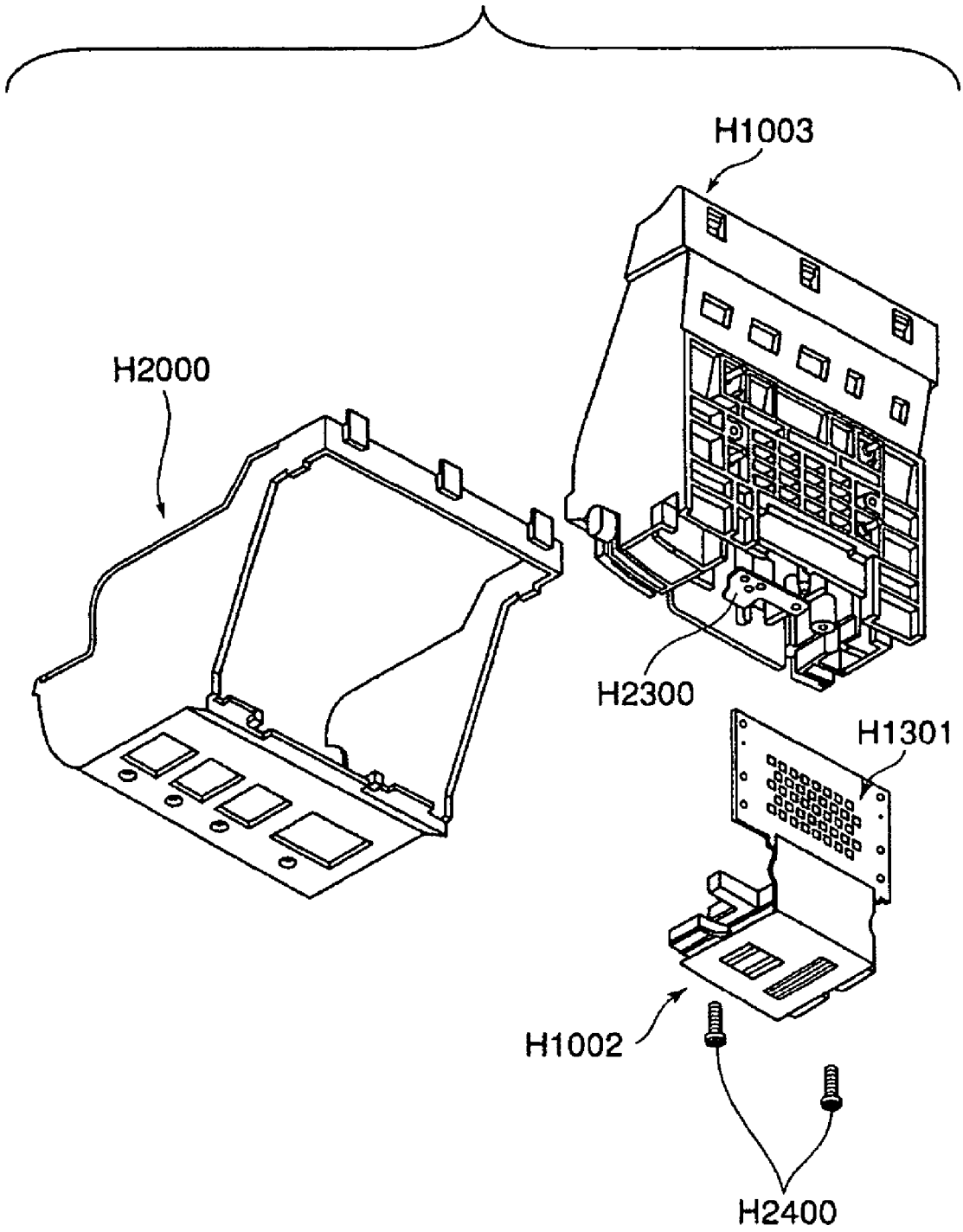
FIG. 2 is an exploded perspective view of the liquid discharge recording head shown in FIG. 1.

As shown in the exploded perspective view of FIG. 2, the recording head H1001 includes a recording element unit H1002, an ink supply unit (recording liquid supplying unit) H1003, and a tank holder H2000. In order to connect an ink communicating opening of the recording element unit H1002 and an ink communicating opening of the ink supply unit H1003 so that ink does not leak, the recording element unit H1002 and the ink supply unit H1003 that press-contact each other are secured to each other with screws H2400 through a joint seal member H2300.

Figure 3:
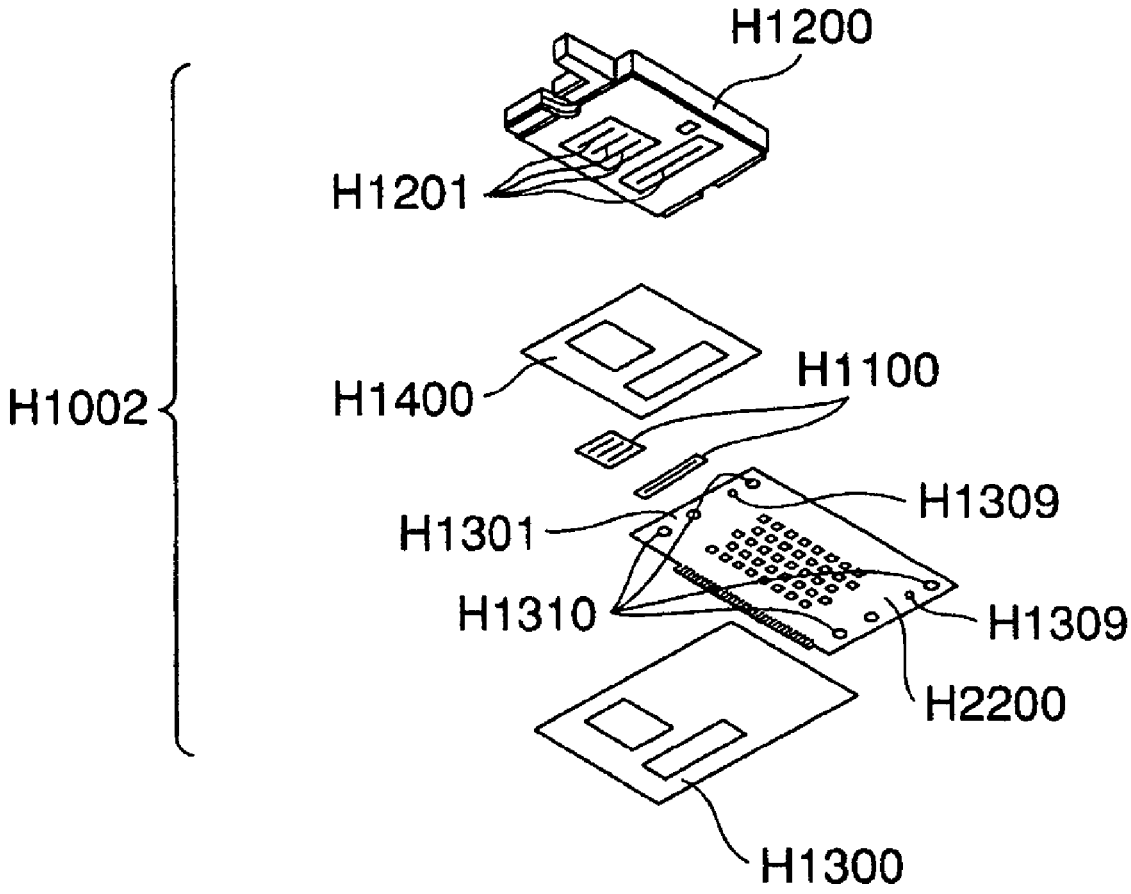
FIG. 3 is an exploded perspective view of a recording element unit of the liquid discharge recording head shown in FIGS. 1A to 2.

As shown in the exploded perspective view of FIG. 3, the recording element unit H1002 includes two inkjet recording substrates H1100, a first plate H1200, an electrical wiring tape H1300, an electrical contact substrate H2200, and a second plate H1400.

As shown in the exploded perspective view of FIG. 3, the inkjet recording substrates H1100 are adhered and secured to the first plate H1200. The second plate H1400 having openings is adhered and secured to the first plate H1200. The electrical wiring tape H1300 is adhered and secured to the second plate H1400 so as to be held by the second plate H1400 by being positioned with respect to the inkjet recording substrates H1100. The electrical wiring tape H1300 is used to apply to the inkjet recording substrates H1100 an electrical signal for discharging ink, has electrical wirings corresponding to the inkjet recording substrates H1100, and is connected to the electrical contact substrate H2200 having an external signal input terminal H1301 that receives an electrical signal from the body of the recording device. The electrical contact substrate H2200 is secured to the ink supply unit 1103 shown in FIG. 2 by being positioned by two terminal positioning holes H1309.

Each inkjet recording substrate H1100 can be a silicon (Si) substrate (having a thickness of about 0.5 mm to 1 mm) having a plurality of heating resistors (heaters) H1103 (e.g., H1103-1 shown in FIG. 4A) on one side thereof. In addition, a plurality of ink flow paths H1104 (e.g., 1104-1) and a plurality of discharge openings H1101 (e.g., 1101-1 shown in FIG. 4B) corresponding to the heaters H1103 are formed on the one side of each substrate H1100 by photolithography (that is, flow path members are formed). Further, each substrate H1100 is connected to its corresponding ink communicating opening H1201 formed in the first plate H1200, and an ink supply opening H1102 for supplying ink to the plurality of ink flow paths H1104 extends towards the opposite side (back side) of each Si substrate. In other words, the recording head H1001 is so called a side shooter head in which the ink supply opening H1102 and the discharge openings H1101 are perpendicular to a plate surface of each inkjet recording substrate H1100 and the ink flow paths H1104.

Figure 4A:
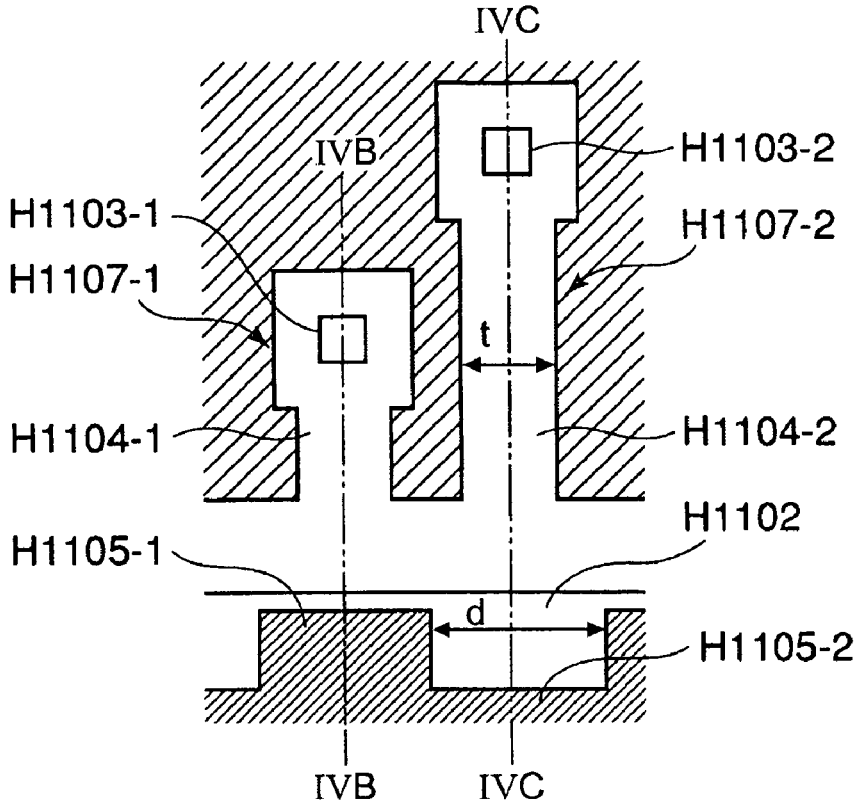
FIG. 4A is a schematic plan view of the main portion of a liquid discharge recording head according to a first embodiment of the present invention.

As shown in the plan view of FIG. 4A, the heaters H1103 are disposed in a staggered arrangement so that their distances from the ink supply opening H1102 differ. Although, for the sake of simplicity, only two heaters are shown, two rows of the plurality of heaters H1103 are disposed on respective sides of the ink supply opening H1102. In addition, since the discharge openings H1101 oppose the heaters H1103, ink supplied from the ink supply opening H1102 is discharged from the discharge openings by bubbles that are generated by heating of the heaters H1103.

The inkjet recording substrates H1100, which are the main portions in the present invention, will hereunder be described in more detail with reference to two embodiments.

First Embodiment

Figure 4B:
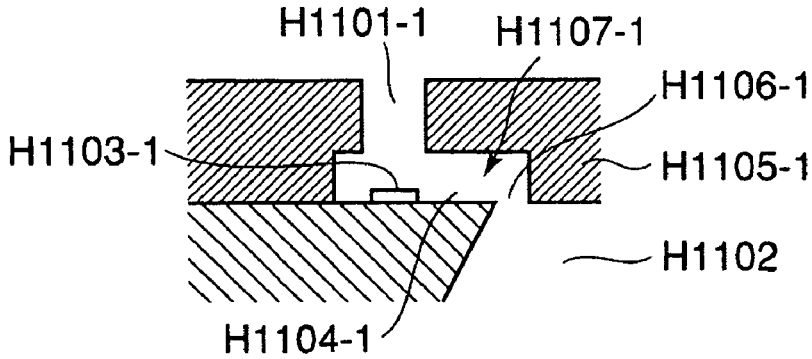
FIG. 4B is a sectional view taken along line IVB-IVB of FIG. 4A.
Figure 4C:
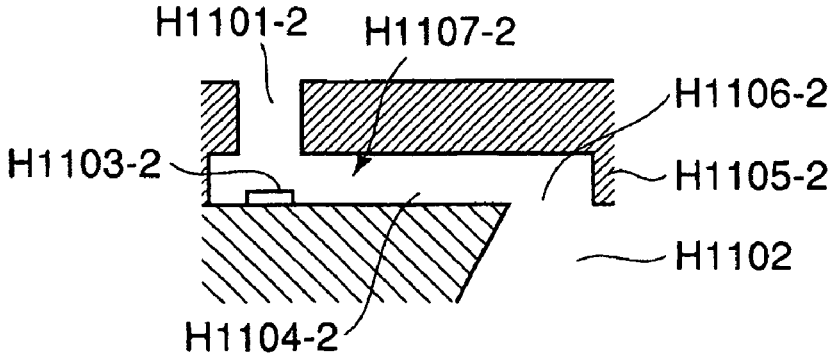
FIG. 4C is a sectional view taken along line IVC-IVC of FIG. 4A.

An inkjet discharge recording head H1100 according to a first embodiment of the present invention will be described with reference to FIGS. 4A to 5B. FIG. 4A is a schematic plan view of heaters H1103, an ink supply opening H1102, ink flow paths H1104, and resisters H1105. FIGS. 4B and 4C are sectional views taken along line IVB-IVB and line IVC-IVC of FIG. 4A, respectively. Here, the term "nozzle H1107" will be used as a general term referring to both an ink flow path H1104 and a discharge opening H1101. Each heater H1103 is disposed in its corresponding nozzle H1107 so as to oppose its corresponding discharge opening H1101. Each nozzle H1107 is connected to the ink supply opening H1102 having the form of a long groove. For the sake of simplicity, in FIGS. 4A to 4C, only two nozzles H1107-1 and H1107-2 of the plurality of nozzles H1107 are shown. The discharge openings of the nozzles H1107-1 and H1107-2 are represented by symbols H1101-1 and H1101-2, respectively, the heaters at the nozzles H1107-1 and H1107-2 are represented by symbols H1103-1 and H1103-2, respectively, and the ink flow paths at the nozzles H1107-1 and H1107-2 are represented by symbols H1104-1 and H1104-2, respectively, in order to distinguish between the discharge openings, the heaters, and the flow paths at the nozzles H1107-1 and H1107-2.

The nozzles H1107-1 and H1107-2 are disposed at a density of 900 dpi (the number of nozzles per 2.54 cm). Similarly, the heaters H1103-1 and H1103-2 are disposed at a density of 900 dpi and at a pitch of approximately 28 μm. Since the pitch between the heaters is small, even if an attempt is made to place the heaters H1103-1 and H1103-2 side by side and to form the nozzles so as to provide sufficient space around the heaters H1103-1 and H1103-2, enough space cannot be provided for disposing the nozzles. In addition, the nozzles cannot be sufficiently spaced apart, thereby making it difficult to provide the required clearances when producing the nozzles. Therefore, in this embodiment, the heaters H1103-1 and H1103-2 are disposed in a staggered arrangement so that their distances from the ink supply opening H1102 differ.

In this structure, in the nozzles H1107-1 and H1107-2 that are adjacent each other, the distance from the discharge opening H1101-1 facing the heater H1103-1 to the ink supply opening H1102 differs from the distance from the discharge opening H1101-2 facing the heater H1103-2 to the ink supply opening H1102. Therefore, the flow path resistances of the nozzles H1107-1 and H1107-2 differ due the different distances. In general, the flow path resistance of the nozzle H1107-2 having a large distance from the discharge opening H1101-2 to the ink supply opening H1102 is larger than the flow path resistance of the nozzle H1107-1 having a small distance from the discharge opening H1101-1 to the ink supply opening H1102. If the flow path resistances upstream from the discharge openings H1101-1 and H1101-2 differ, the direction in which ink tends to flow at the nozzle H1107-1 when bubbling differs from the direction in which ink tends to flow at the nozzle H1107-2 when bubbling. This results in different discharge characteristics between the nozzles H1107-1 and H1107-2, such as differences in ink refill frequencies, ink discharge amounts, and ink discharge speeds.

In order to reduce the differences between the discharge characteristics of the nozzles disposed in a staggered arrangement, in the embodiment, resisters H1105-1 and H1105-2 are formed at the ink supply opening H1102 at the same time that the nozzle walls are formed by using a material that is the same as the material of the nozzle walls.

The resisters H1105-1 and H1105-2 make narrow communicating portions (connecting portions) H1106-1 and H1106-2 between the ink supply opening H1102 and the respective ink flow paths H1104-1 and H1104-2 by partly blocking the communicating portions H1106-1 and H1106-2. By changing the positions or forms of the resisters H1105-1 and H1105-2 in accordance with the lengths of the nozzles H1107-1 and H1107-2 disposed in a staggered arrangement, the flow path resistances are adjusted. The resisters are integrally formed. For the sake of simplicity, the resister at the short ink flow path H1104-1 is referred to as the resister H1105-1, and the resister at the long ink flow path H1104-2 is referred to as the resister H1105-2. Here, a width (d) of the resister H1105-2 is larger than a flow path width (t) of the corresponding ink flow path H1104-2. The boundary of the resisters H1105-1 and H1105-2 is disposed at a location corresponding to the nozzle wall between the nozzles H1107-1 and H1107-2. By virtue of this structure, the flow path resistance between the ink flow path H1104-1 and the ink supply opening H1102 is larger than the flow path resistance between the ink flow path H1104-2 and the ink supply opening H1102.

Since the resisters are disposed at the ink supply opening, they may be formed relatively independently of the positions of the nozzles H1107-1 and H1107-2.

Accordingly, in the embodiment, when the nozzles H1107-1 and H1107-2 are disposed in a staggered arrangement, the resisters H1105 disposed at the ink supply opening H1102 are like ridges and valleys in accordance with the nozzles H1107-1 and H1107-2 disposed in a staggered arrangement. Therefore, it is possible to equalize the flow path resistances at locations upstream from the discharge openings H1101-1 and H1101-2.

Figure 5A:
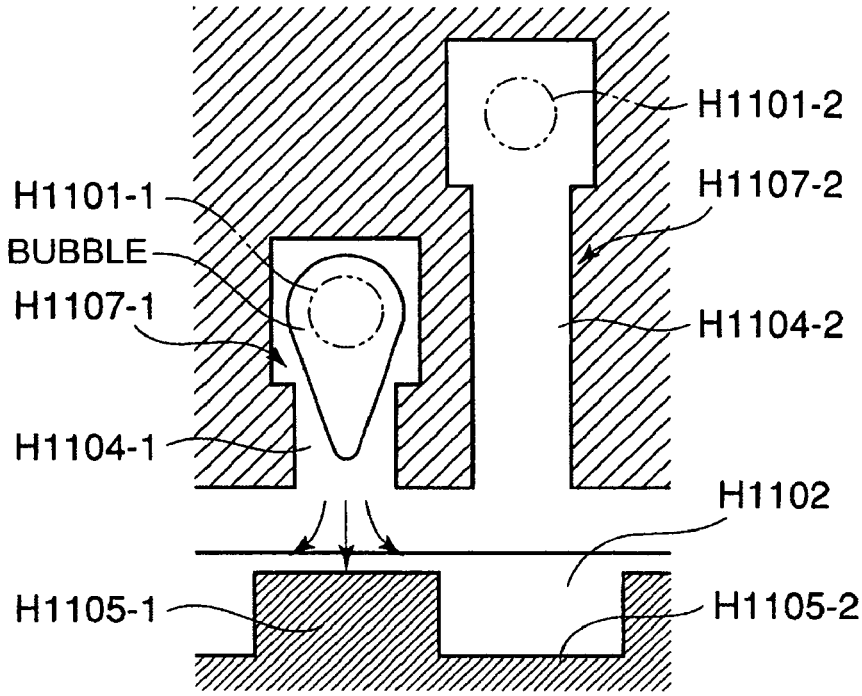
FIG. 5A is a schematic view showing a liquid discharge state in a short nozzle of the liquid discharge recording head shown in FIGS. 4A and 4B.
Figure 5B:
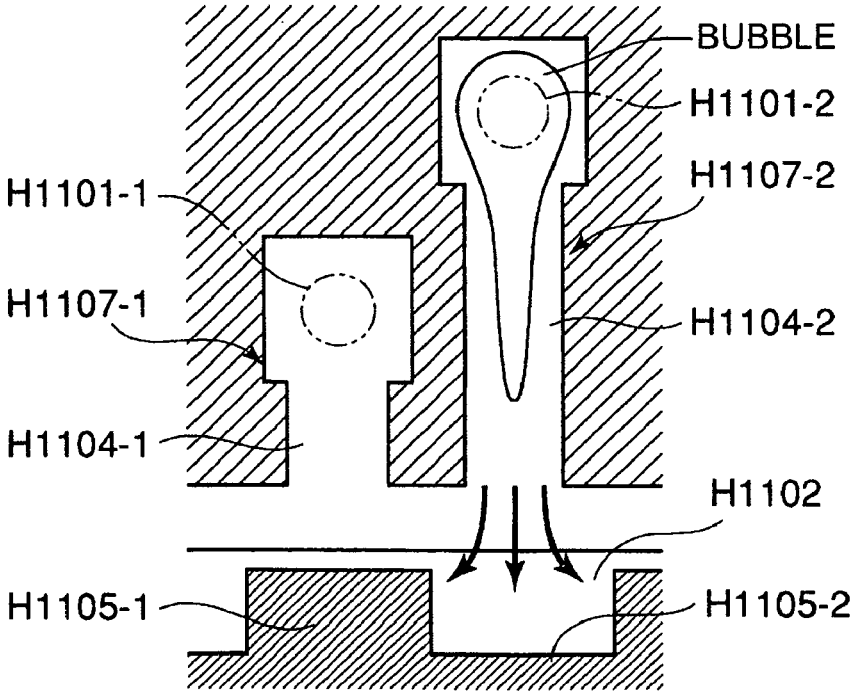
FIG. 5B is a schematic view showing a liquid discharge state in a long nozzle of the liquid discharge recording head shown in FIGS. 4A and 4C.

FIGS. 5A and 5B schematically show bubbled states of ink when the heaters H1103 according to the embodiment are driven. FIG. 5A shows the bubbled state in the nozzle H1107-1 having a small distance from the discharge opening H1101-1 to the ink supply opening H1102, and FIG. 5B shows the bubbled state in the nozzle H1107-2 having a large distance from the discharge opening H1101-2 to the ink supply opening H1102.

As shown in FIG. 5A, when the ink in the short nozzle H1107-1 bubbles, the ink flows towards the upstream side of the nozzle H1107-1 as indicated by the arrows shown in FIG. 5A. In this case, since the communicating portion H1106-1 between the ink supply opening H1102 and the ink flow path H1104-1 is narrowed by the resister H1105-1 disposed at the ink supply opening H1102, the flow path resistance is large. Therefore, the flow of the ink towards the ink supply opening H1102 is restricted, thereby reducing the ink refill frequency. In addition, since a portion of the ink flowing towards the ink supply opening H1102 flows towards the resister H1105-2, the flow of the ink towards the ink flow path H1104-2 adjacent the resister H1105-2 is restricted. As a result, it is possible to reduce cross-talk.

As shown in FIG. 5B, when the ink in the long nozzle H1107-2 bubbles, the ink flows towards the upstream side of the nozzle H1107-2 as indicated by the arrows shown in FIG. 5B. In this case, since the communicating portion H1106-2 between the ink supply opening H1102 and the ink flow path H1104-2 is made relatively wide by the resister H1105-2 disposed at the ink supply opening H1102, the flow path resistance is small. Therefore, the flow of the ink towards the ink supply opening H1102 is increased, thereby increasing the ink refill frequency. In addition, the ink flows towards the communicating portion H1106-2 as shown in FIG. 5B, so that it does not flow towards the adjacent nozzle. This is because the ink flow path is sufficiently long and the flow resistance at the communicating portion H1106-2 is smaller than the flow resistance at a space between the adjacent nozzle wall and ink supply opening.

Accordingly, by disposing the resisters H1105-1 and H1105-2 at the ink supply opening H1002, it is possible to match the discharge characteristics, such as the refill frequencies, of the nozzles H1107-1 and H1107-2 to a high level.

Second Embodiment

Figure 6A:
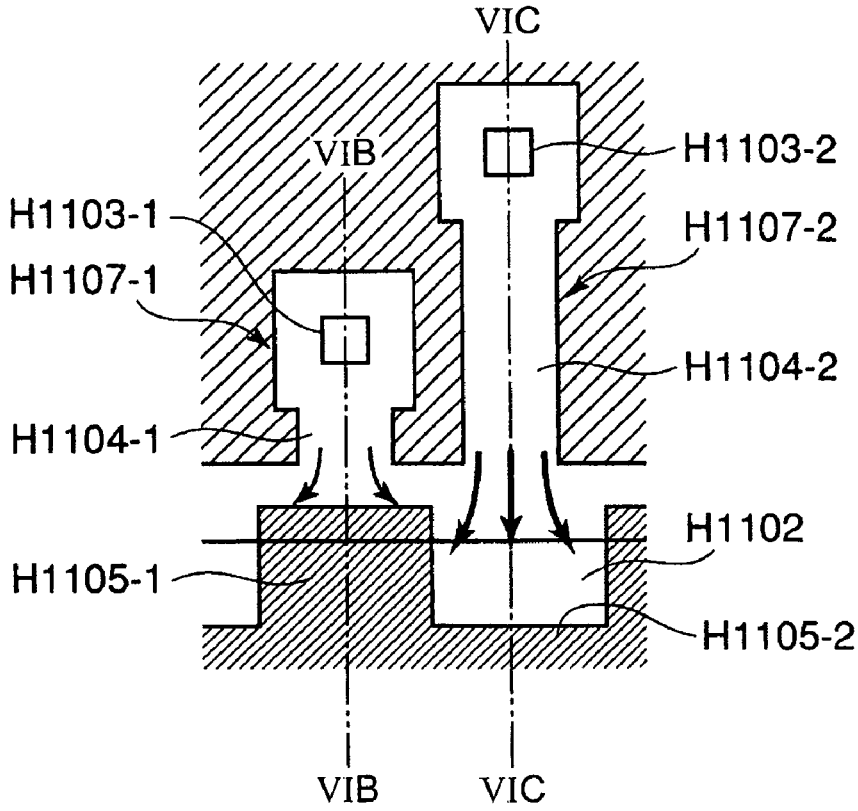
FIG. 6A is a schematic plan view of the main portion of a liquid discharge recording head according to a second embodiment of the present invention.
Figure 6B:
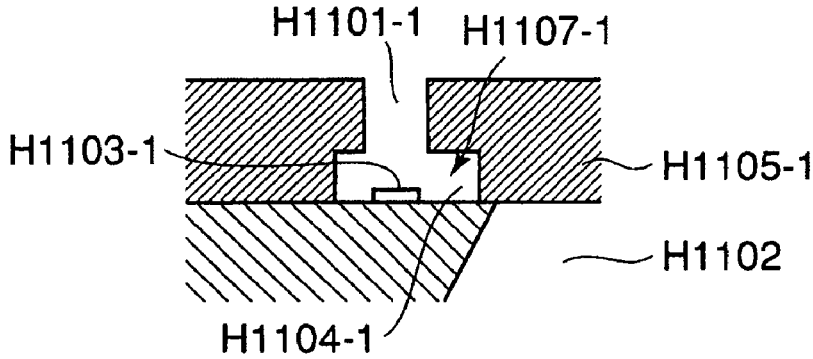
FIG. 6B is a sectional view taken along line VIB-VIB of FIG. 6A.
Figure 6C:
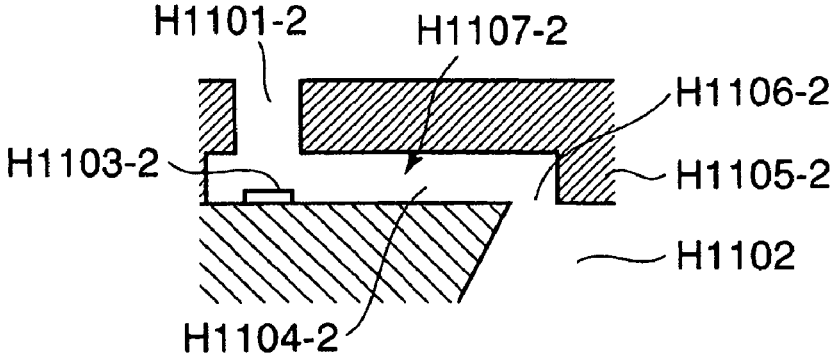
FIG. 6C is a sectional view taken along line VIC-VIC of FIG. 6A.

FIGS. 6A to 6C are schematic plan views of a liquid discharge recording head H1100 according to a second embodiment of the present invention.

The second embodiment differs from the first embodiment in that a portion of a resister H1105-1 protrudes to a location between an ink supply opening and an ink flow path.

In the second embodiment, a communicating portion between an ink flow path H1104-1 and an ink supply path H1102 is blocked by the resister H1105-1, allowing for a high discharge frequency to be achieved. In addition, the second embodiment is an excellent embodiment when one wants to strengthen the material defining the flow path of the liquid discharge head or to reduce the area of a substrate.

In the second embodiment, as shown in FIGS. 6A to 6C, at the upstream side of a nozzle H1107 having a small distance from a discharge opening H1101-1 to the ink supply path H1102, the resister H1105-1 is formed so as to extend around the inside of the ink flow path H1104 from a location opposing the ink supply opening H1102. Therefore, since, at the upstream side of the nozzle H1107-1, the communicating portion between the ink flow path H1104-1 and the ink supply path H1102 is blocked by the resister H1105-1, the flow of ink (shown by the arrows in FIG. 6A) is restricted by a larger degree than in the structure of the first embodiment.

At the upstream side of a nozzle H1107-2 having a large distance from a discharge opening H1101-2 to the ink supply opening H1102, a resister H1105-2 is disposed only at a location opposing the ink supply opening H1102. Therefore, a communicating portion H1106-2 between an ink supply path H1104-2 and the ink supply opening H1102 is wide, as a result of which the flow path resistance between the ink supply path H1104-2 and the ink supply opening H1102 is small.

According to the embodiment, even in the structure in which the nozzles H1107 and the heaters H1103 are disposed in a staggered arrangement and are brought as close as possible to the ink supply opening H1102, good discharge characteristics can be obtained by suitably changing the positions and forms of the resisters H1105.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2005-115985 filed Apr. 13, 2005, which is hereby incorporated by reference herein in its entirety.

What is claimed is:

1. A liquid discharge recording head comprising:

a substrate having a plurality of heat generating resistors generating heat energy used for discharging the liquid and a liquid supply opening facilitating supplying the liquid to the heat generating resistors;

a flow path member having a plurality of discharge openings and a plurality of flow paths, the plurality of discharge openings being disposed in correspondence with the plurality of heat generating resistors, the plurality of flow paths connecting the plurality of discharge openings and the liquid supply opening to each other, wherein the plurality of liquid flow paths comprise a first flow path and a second flow path that are adjacent each other, the second flow path being longer than the first flow path, the first flow path having a substantially consistent flow path width along a length of the first flow path, the second flow path having a substantially consistent flow path width along a length of the second flow path; and a first resister corresponding to the first flow path and a second resister corresponding to the second flow path, each of the first resister and the second resister being disposed at an area of the flow path member that is opposing the liquid supply opening, wherein an amount of protrusion of the first resister at a side of the first flow path is greater than an amount of protrusion of the second resister at a side of the second flow path, and wherein a distance between the first resistor and the first flow path is smaller than a distance between the second resistor and the second flow path.

2. The liquid discharge recording head according to claim 1, wherein the first resister and the second resister are continuously disposed.

3. The liquid discharge recording head according to claim 1, wherein each resister restricts a size of a communicating portion between the corresponding ink flow path and the ink supply opening.

4. The liquid discharge recording head according to claim 1, wherein the first resister is disposed so as to extend around an inside of the ink flow path from a location opposing the ink supply opening.

5. The liquid discharge recording head according to claim 1, wherein the plurality of discharge openings are disposed at a density of at least 900 dpi.

6. The liquid discharge recording head according to claim 2, wherein a boundary between the first resister and the second resister is disposed at a location corresponding to a flow path wall between the first flow path and the second flow path.

7. The liquid discharge recording head according to claim 6, wherein a width of the second resister is greater than a width of the second flow path.

* * * * *